US006311777B1

(12) United States Patent
Milne et al.

(10) Patent No.: US 6,311,777 B1
(45) Date of Patent: Nov. 6, 2001

(54) WELL LOGGING TOOL

(75) Inventors: Alex Watson Milne, Aberdeen; Michael Charles Spencer, Melton Mowbray, both of (GB)

(73) Assignee: Reeves Wireline Technologies Ltd. (GB)

( * ) Notice: Subject to any disclaimer, the term of this patent is extended or adjusted under 35 U.S.C. 154(b) by 0 days.

(21) Appl. No.: 09/449,052

(22) Filed: Nov. 24, 1999

(30) Foreign Application Priority Data

Nov. 28, 1998 (GB) ..... 9826022

(51) Int. Cl.[7] ..... E21B 34/00
(52) U.S. Cl. ..... 166/319; 166/332.1
(58) Field of Search ..... 166/316, 319, 166/320, 321, 325, 332.1, 332.7, 334.4, 373

(56) References Cited

U.S. PATENT DOCUMENTS 3,692,106 * 9/1972 Basham et al. ..... 166/53
4,041,780 8/1977 Angehrn .
4,386,422 * 5/1983 Mumby et al. ..... 367/85
4,553,599 * 11/1985 Glotin ..... 166/332
5,095,983 * 3/1992 Magnani ..... 166/250.01
5,099,919 * 3/1992 Schneider et al. ..... 166/188
5,117,685 * 6/1992 Goldschild ..... 166/319 X
5,209,304 * 5/1993 Nice ..... 166/383
5,404,946 * 4/1995 Hess ..... 166/187

FOREIGN PATENT DOCUMENTS

2232177 A 5/1989 (GB) .

* cited by examiner

*Primary Examiner*—Frank S. Tsay
(74) *Attorney, Agent, or Firm*—Paul & Paul

(57) ABSTRACT

The well logging tool comprises differential valve means allowing passage of fluid through said tool during logging operations on when the tool becomes jammed inside a drillpipe.

8 Claims, 3 Drawing Sheets

WELL LOGGING TOOL

The present invention relates to well logging tools and more particularly to well logging tools which can be battery operated allowing free movement of the tool. The tool could, however, be more conventionally employed with connecting cable.

It is an object of the present invention to provide a well logging tool which includes means for allowing passage of fluid through the tool.

The present invention provides a well logging tool, including a fluid flow unit, said fluid flow unit including differential pressure valve means, said differential pressure valve means comprising means for allowing passage of fluid from a first inlet grille means to a second outlet grille means.

In a preferred embodiment the differential pressure valve means is bi directional allowing passage of fluid through said fluid flow unit in two directions.

Preferably the well logging tool comprises a first, in use, upper section comprising said fluid flow unit and a second in use lower section comprising a logging data section securely attached in longitudinal alignment to said first section. Preferably said tool and second sections comprise generally elongate cylindrical sections.

Preferably said first section comprises at least one enlarged portion, having a diameter larger than the diameter of the second section. In a preferred embodiment the first section includes two enlarged portions, spaced apart on the length of the first section.

Preferably said grilles are situated on a smaller diameter portion of said first section to thereby allow free passage of said fluid past the logging tool.

Preferably said differential pressure means comprises a piston slideably mounted in a cylinder. Said piston is spring biased towards a normally closed valve position to prevent passage of fluid through said cylinder.

Preferably said piston is movable within the cylinder in two directions to enable fluid paths to be open allowing passage of fluid in a first and a second direction.

In use said first and second directions respectively comprise passage of fluid down a drillpipe and upwardly within said drillpipe.

Figure 1:
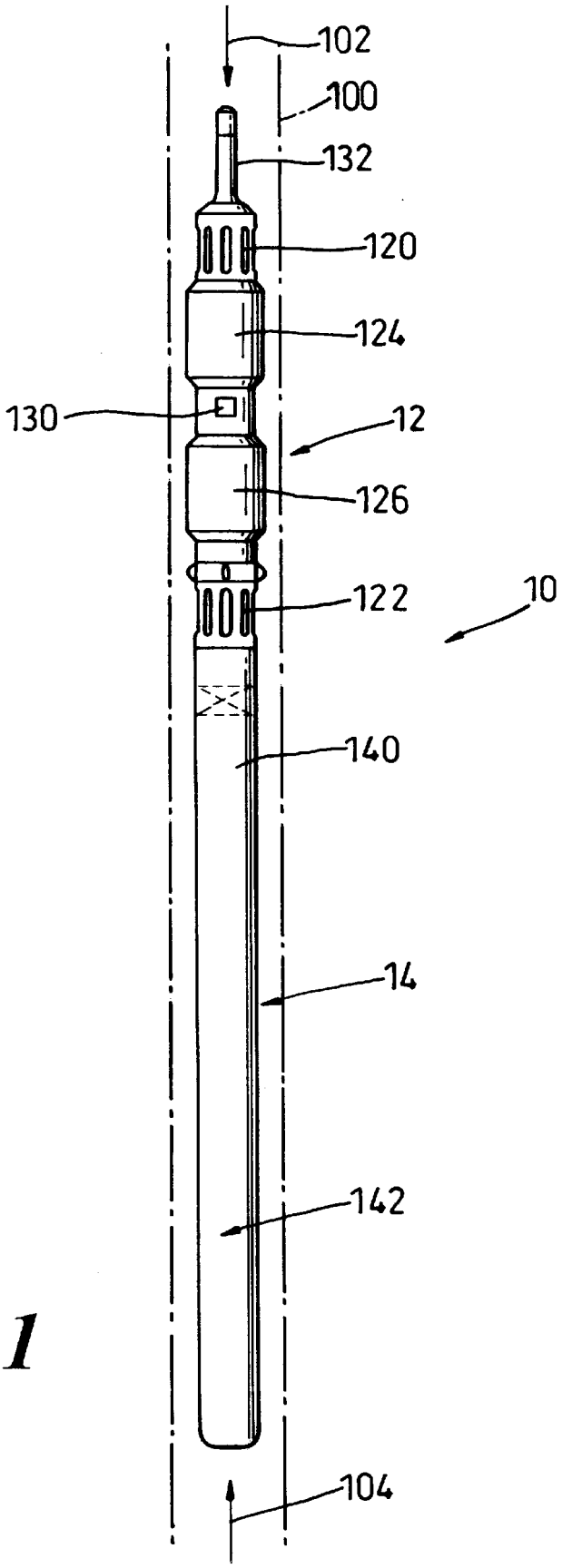
Figure 2:
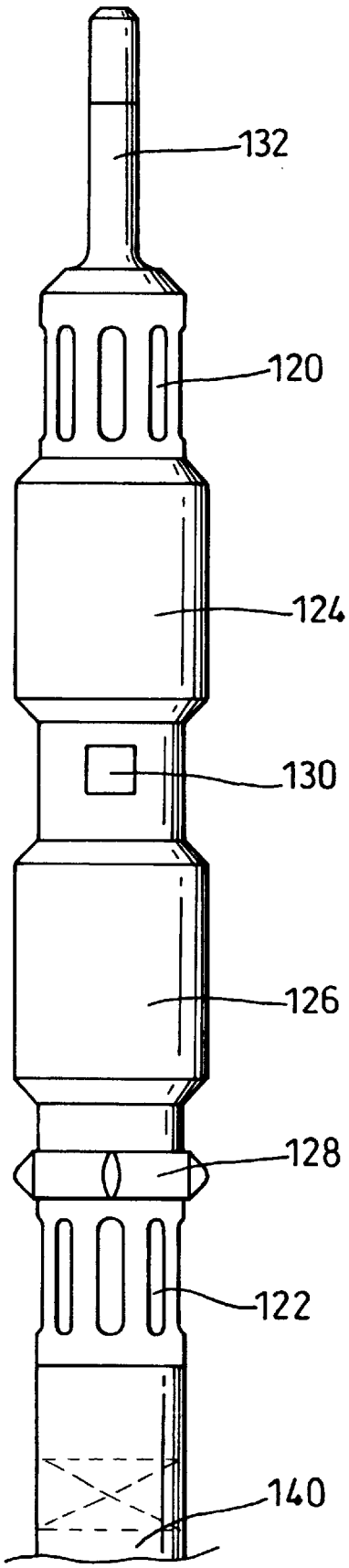
Figure 3:
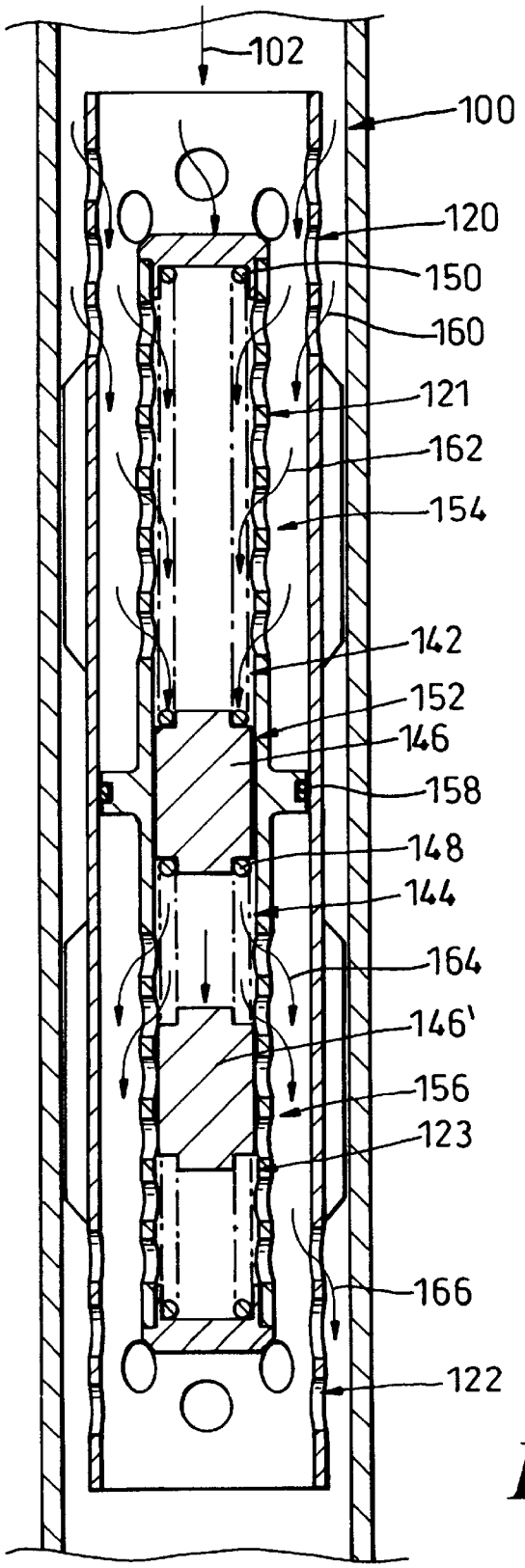

Embodiments of the present invention will now be discussed, by way of example with reference to the accompanying drawings in which:

FIG. 1 shows diagrammatically a well logging tool in accordance with the present invention, FIG. 2 shows the fluid flow unit of the well logging tool of FIG. 1 in greater detail and, FIG. 3 shows the fluid flow unit of FIG. 2 in cross sectional elevation.

With reference now to FIG. 1 the well logging tool 10 comprises a generally elongate cylindrical construction including a first upper section 12 and a second lower section 14. The phrases upper and lower sections are used to indicate the normal directional of insertion of the tool 10 into a borehole (now shown).

The first section 12 comprises a fluid flow unit, the operation of which will be explained in greater detail with reference to FIGS. 2 and 3.

The second lower section 14 comprises a well data logging section which may include a battery and memory pack section 140 and a calliper/sensor section 142.

The battery/memory section 140 enables the logging tool to be free from any control cables. The logging tool could, however, be connected by a conventional cable arrangement should this be preferred. Normally, however, the logging tool will be battery powered.

The data logging sensors and calliper unit may be of conventional designs which are well known in this art and therefore they will not be described further.

With reference now to FIG. 2, the fluid flow unit comprises a first upper fluid entry/exit port 120 and a second lower fluid entry/exit port 122.

Adjacent to the upper fluid entry port 120 is a larger diameter section 124 and adjacent to the lower entry port 122 is a further larger section 126. A segmented landing collar 128 is preferably situated between the lower fluid energy part 122 and the larger diameter section 126.

A differential pressure release valve 130 is situated between enlarged diameter sections 124, 126. A fishing neck 132 is provided at the upper end of section 12.

In operation the well logging tool will normally not allow fluid flow therethrough. Thus, when fluid pressure is applied within a drill pipe 100 (shown dotted in FIG. 1) in the direction of arrow 102 the logging tool will be propelled in that direction and in direction 104 when fluid pressure is applied in that direction.

The operation of the valve means is explained with reference to FIG. 3, which shows in cross section the operative part of the first section 12.

The valve means comprises two cylinders 142, 144 and a piston 146. Piston 146 is free to move within the cylinders, but is normally maintained in a central position as indicated by reference numeral 146 by two coil springs 148, 150.

Normally piston 146 closes the central portion 152 between cylinders 142, 144 and thus prevents any passage of fluid from grille 120 to grille 122. Passage of fluid via internal passages 154, 156 is prevented by suitable seal means 158. Thus, in normal use fluid pressure in the direction of arrow 102 will push on the end of 12 of logging tool 10 and cause it, unless it is obstructed, to move in the direction of arrow 102.

If the logging tool becomes stationary then the fluid flow 102 will be halted.

If in a preferred embodiment of the invention fluid pressure in the drill pipe 100 remains the same as in the logging tool transportation made, then piston 146 will not move substantially.

However, if pressure is allowed to buildup on the said of inlet grille 120 then the differential pressure across piston 146 will increase and this will then force piston 146 downwardly until it is in position 146'.

The fluid flow will then follow arrows 160, 162, 164, 166 allowing fluid to pass through grilles 120, 121, through cylinders 142, 144 and through grille 123 and outlet grille 122 to pass on down the drill pipe 100.

In like manner, if the fluid flow is reversed, piston 146 will move to the upper cylinder 142 and the fluid flow through the valve unit will occur in a reverse direction.

The valve unit therefore allows passage of fluid through the drill pipe at all times even when logging is occurring as described in the co-pending UK application no. 9826007.8 filed on Nov. 28, 1998.

What is claimed is:

1. A well logging tool, including a fluid flow unit, said fluid flow unit including differential pressure valve means, said differential pressure valve means comprising means for allowing passage of fluid from a first inlet grille means to a second outlet grille means, the differential pressure valve means being bi-directional to allow passage of fluid through the fluid flow unit in two directions.

2. A well logging tool as claimed in claim 1 in which the well logging tool comprises an in use first, upper section comprising said fluid flow unit and an in use second lower section comprising a logging data section securely attached in longitudinal alignment to said first section.

3. A well logging tool as claimed in claim 2 in which said tool and said second section comprise a generally elongate cylindrical section.

4. A well logging tool as claimed in any one of claims 1, 2 or 3 in which said first section comprises at least one enlarged portion, having a diameter larger than the diameter of the second section.

5. A well logging tool as claimed in claim 4 in which the first section includes two enlarged portions, spaced apart on the length of the first section.

6. A well logging tool as claimed in claim 5 in which said grilles are situated on a smaller diameter portion of said first section to thereby allow free passage of said fluid past the logging tool.

7. A well logging tool as claimed in claim 6 in which said differential pressure means comprises a piston slideably mounted in a cylinder, said piston being spring biased towards a normally closed valve position to prevent passage of fluid through said cylinder.

8. A well logging tool as claimed in claim 7 in which said piston is movable within the cylinder in two directions to enable fluid paths to be opened allowing passage of fluid in a first and a second direction.

* * * * *

UNITED STATES PATENT AND TRADEMARK OFFICE

CERTIFICATE OF CORRECTION

PATENT NO. : 6,311,777 B1
DATED : November 6, 2001
INVENTOR(S) : Milne et al.

It is certified that error appears in the above-identified patent and that said Letters Patent is hereby corrected as shown below:

Column 1,
Line 55, please delete "directional" and replace with -- direction --.

Column 2,
Line 11, please delete "energy part" and replace with -- entry port --.
Line 42, please insert -- side -- after "said".

Signed and Sealed this

Twenty-eighth Day of May, 2002

*Attest:*

*Attesting Officer*

JAMES E. ROGAN
*Director of the United States Patent and Trademark Office*